US009058024B2

(12) United States Patent
Montanye et al.

(10) Patent No.: US 9,058,024 B2
(45) Date of Patent: Jun. 16, 2015

(54) USER INTERFACE—OVEN TIMER

(71) Applicant: BSH Home Appliances Corporation, Irvine, CA (US)

(72) Inventors: Phillip Montanye, New Bern, NC (US); Graham Sadtler, Huntington Beach, CA (US); Elysa Soffer, San Francisco, CA (US); Robert Tannen, Philadelphia, PA (US)

(73) Assignee: BSH Home Appliances Corporation, Irvine, CA (US)

( * ) Notice: Subject to any disclaimer, the term of this patent is extended or adjusted under 35 U.S.C. 154(b) by 243 days.

(21) Appl. No.: 13/735,271

(22) Filed: Jan. 7, 2013

(65) Prior Publication Data

US 2014/0192623 A1 Jul. 10, 2014

(51) Int. Cl.

| | |
|---|---|
| ***H05B 1/02*** | (2006.01) |
| ***G04G 15/00*** | (2006.01) |
| ***F24C 7/08*** | (2006.01) |

(52) U.S. Cl.

CPC ..... *G04G 15/003* (2013.01); *F24C 7/08* (2013.01)

(58) Field of Classification Search

CPC ..... G04G 15/003; F24C 7/08; F24C 7/081; F24C 7/082; F24C 7/085; H05B 1/0263; H05B 1/0266; H05B 3/0076; H05B 6/12; H05B 6/687; H05B 2213/04

USPC ..... 219/492, 506, 719, 720, 443.1, 446.1, 219/412–414, 445.1, 448.11; 99/335, 327

See application file for complete search history.

(56) References Cited

U.S. PATENT DOCUMENTS

| | | | | |
|---|---|---|---|---|
| 4,351,999 | A * | 9/1982 | Nagamoto et al. | 219/705 |
| 5,813,320 | A * | 9/1998 | Frasnetti et al. | 99/333 |
| 7,041,941 | B2 * | 5/2006 | Faries et al. | 219/413 |
| 7,151,968 | B2 * | 12/2006 | Williamson | 700/65 |
| 7,566,168 | B2 * | 7/2009 | Rund et al. | 374/102 |
| 7,953,632 | B2 * | 5/2011 | Salerno | 705/15 |
| 2005/0029249 | A1 * | 2/2005 | Wanat | 219/494 |

OTHER PUBLICATIONS

Matt Grover, Kitchen Timer, Online: Matt Grover's Blog, Dec. 7, 2010.

* cited by examiner

*Primary Examiner* — Mark Paschall

(74) *Attorney, Agent, or Firm* — James E. Howard; Andre Pallapies

(57) ABSTRACT

A domestic appliance with timer control for the treatment of contents, the domestic appliance comprising a timer configured to track a treatment time period, a display configured to display a plurality of screens, at least one user input component programmed to receive a treatment time input corresponding to a treatment time and receive an expiration function input corresponding to an expiration function subsequent to receiving the treatment time input, and a controller programmed to set the timer with the treatment time in accordance with the received treatment time input and set the expiration function.

19 Claims, 10 Drawing Sheets

700

702

704

USER INTERFACE—OVEN TIMER

FIELD OF THE TECHNOLOGY

The present technology relates to a user interface for a domestic appliance, e.g., an oven. More particularly, the present technology relates to a timer associated with the user interface.

BACKGROUND OF THE TECHNOLOGY

In common domestic appliances today where an item is to be treated for a defined period of time, e.g., cooking food in an oven, a timer is provided as part of the user interface. This allows the user to set the timer and focus on other tasks while the item is treated in the appliance without having to actively track the time of treatment. The timer will perform a function at its expiration. Commonly, the function initiated by expiration of the timer is alerting the user that the treatment time has expired and/or turning off a treatment element of the appliance.

However, domestic appliances with a timer function also require that the user indicate prior to setting the duration of the timer which function is to be performed upon expiration of the timer. Often in the situation where a food item is cooked in an oven, the predetermined duration of cooking may last an extended period of time. The user may have other tasks to perform and may not be able to predict whether he or she will be available upon expiration of the timer to remove the cooked food item to halt its treatment or if he or she will be away such that the oven needs to turn itself off to prevent extended treatment that is not desired, e.g., overcooking.

In other words, the user may know all of the relevant treatment parameters before initiating treatment by the domestic appliance and therefore the user may program the appliance with these parameters in advance of treatment. There may, however, be a temporal separation between when the user programs the parameters of the appliance and when the user would like to begin treatment. In the case of the oven, a period of time may be also required to allow the oven to preheat to its desired treatment temperature. The user's circumstances may change during this time such that the user may not desire for the domestic appliance to perform the function already programmed after the expiration of the timer.

Thus, presently known domestic appliance timers may present a difficulty to the user in that he or she may not be able to have the domestic appliance timer perform the desired function upon expiration of the timer.

SUMMARY OF THE TECHNOLOGY

One aspect of the present technology is to provide a user interface for a domestic appliance, including a timer, and a method for controlling the same that overcomes one or more shortcomings of the prior art.

Another aspect of the present technology is directed to a domestic appliance, e.g., an oven, with timer control for the treatment of contents. The domestic appliance comprises a timer configured to track a treatment time period, a display configured to display a plurality of screens, at least one user input component programmed to receive a treatment time input corresponding to a treatment time and receive an expiration function input corresponding to an expiration function subsequent to receiving the treatment time input, and a controller programmed to set the timer with the treatment time in accordance with the received treatment time input and set the expiration function.

In examples, (a) the domestic appliance may comprise an audio transducer configured to emit an audible alert, (b) the display may be configured to display a visual alert, (c) the domestic appliance may comprise at least one treatment element configured to treat the contents, (d) the controller may be programmed to direct the audio transducer to emit an audible alert, direct the display to emit a visual alert and/or control the at least one treatment element, (e) the expiration function may be an alert function, including the audible alert and/or the visual alert, or a shut-off function, including shutting off the at least one treatment element and at least one of the audible alert and the visual alert, (f) the timer may be programmed to indicate to the controller that the treatment time has expired, and/or (g) the controller may be programmed to initiate the expiration function after the treatment time has expired.

Another aspect of the present technology is directed to a method for controlling a domestic appliance through a user interface that treats contents (e.g., cooking) having a display, and at least one user input component. The method comprises displaying a treatment time screen, receiving a treatment time input corresponding to a treatment time from the at least one user input component, and, subsequent to receiving the treatment time input, displaying an expiration function screen, and receiving an expiration function input corresponding to an expiration function from the at least one user input component.

In examples, (a) the expiration function may comprise an alert function to alert a user or a shut-off function to cease treatment of the contents and alert the user, (b) the method may comprise programming a timer to track a treatment time, (c) the method may comprise tracking a treatment time with the timer, (d) the method may comprise programming a controller to perform the expiration function upon expiration of the treatment time, (e) the method may comprise treating the contents of the domestic appliance with at least one treatment element for the duration of the treatment time and performing the expiration function upon expiration of the treatment time, (f) the method may comprise performing the alert function by emitting an audible alert with an audio transducer and/or emitting a visual alert with the display, and/or (g) the method may comprise performing the shut-off function by shutting off the at least one treatment element and at least one of emitting an audible alert with the audio transducer and emitting a visual alert with the display.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of the present technology. In such drawings.

DETAILED DESCRIPTION OF ILLUSTRATED EMBODIMENTS

The following description is provided in relation to several examples which may share common characteristics and features. It is to be understood that one or more features of any one example may be combinable with one or more features of the other examples. In addition, any single feature or combination of features in any of the examples may constitute additional examples.

Figure 1:
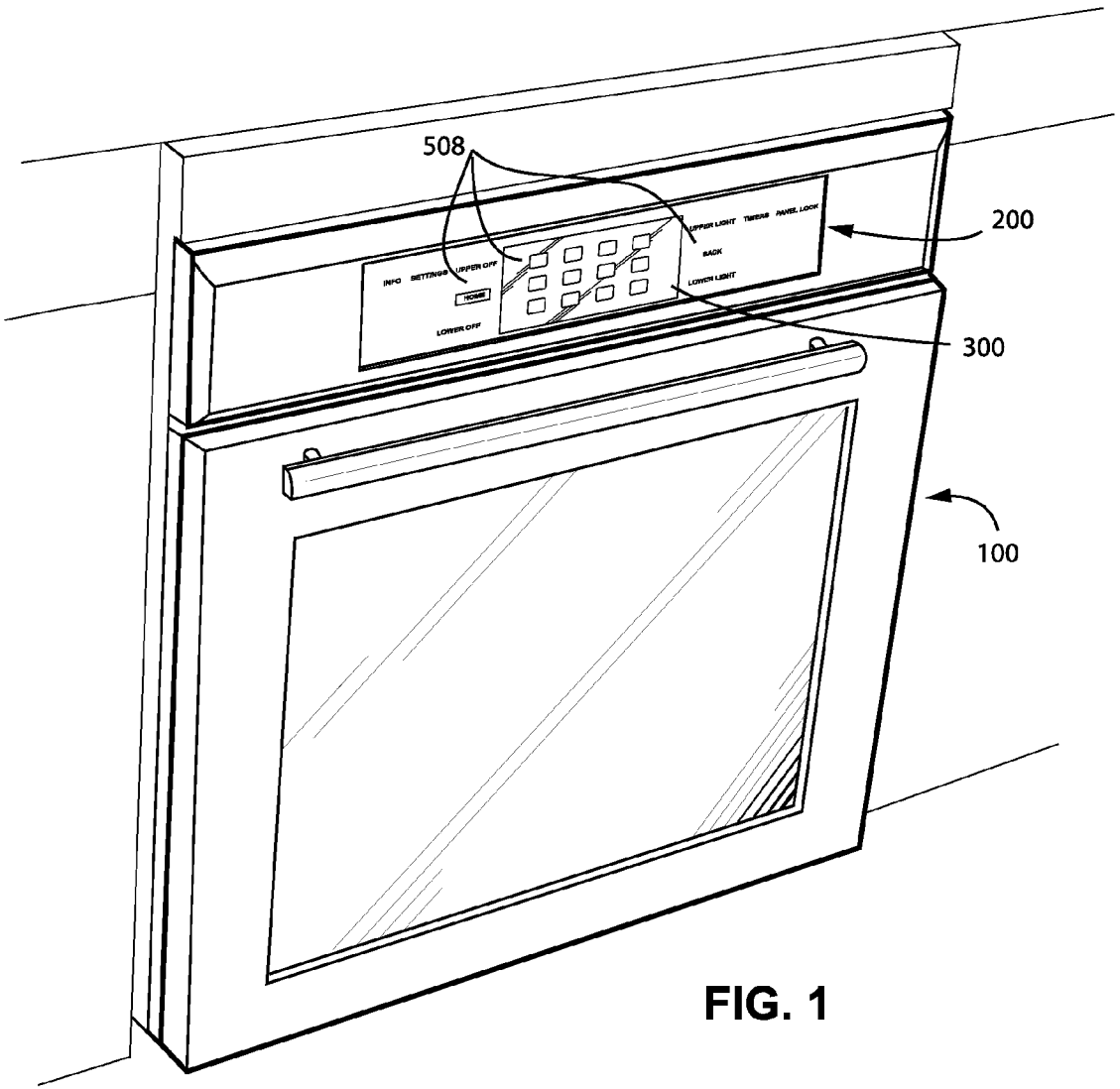
FIG. 1 is a perspective view of a domestic appliance having a user interface, according to an example of the present technology.

FIG. 1 shows a perspective view of a domestic appliance 100 installed as it commonly would be in a home. The particular domestic appliance 100 shown is an oven installed in a wall of a kitchen. The domestic appliance 100 of FIG. 1 shows a user interface 200 having a display 300. In this example, the display 300 may be a thin film transistor display that may include at least one user input component 508 that may be a capacitive touch input element. Also in this example, the display 300 may have a capacitive touch input element included therein. The at least one user input component 508 may comprise the capacitive touch input element included with the display and/or it may comprise a plurality of buttons that also include capacitive touch elements.

Figure 2:
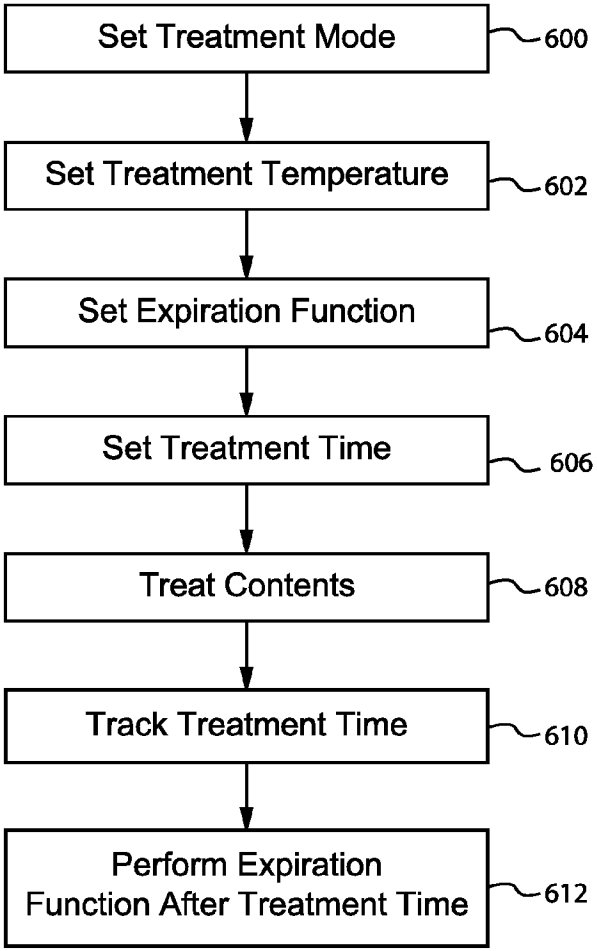
FIG. 2 (RELATED ART)
FIG. 2 is a flowchart of the process of setting a timer of a user interface, according to a related art.

FIG. 2 is a flowchart of an example of a method for controlling a domestic appliance that treats contents in accordance with a related art. This method demonstrates the interaction between the user and the user interface of the appliance. In this method, the user first sets a treatment mode, here a heating mode that may include modes such as conventional baking, convection baking, broiling, warming, etc. The temperature of the treatment is then set. The temperature chosen would be in accordance with a recipe, in the example where the appliance is an oven for cooking food. Typically then, the user will be treating the contents of the appliance therein at the set treatment temperature for a period of time as prescribed by the recipe. To program the duration of treatment according to this method of the related art, the user will first set a function to occur at the end of the prescribed treatment time, then the user will program the treatment time into the user interface. The function may be an alert function that includes audible and/or visual alerts or it may be a shut-off function that includes shutting off an element of the appliance that performs the treatment, as well as audible and/or visual alerts. Following the input of the treatment time, the user will initiate the treatment and the function selected by the user will occur at the end of the treatment time.

Figure 3:
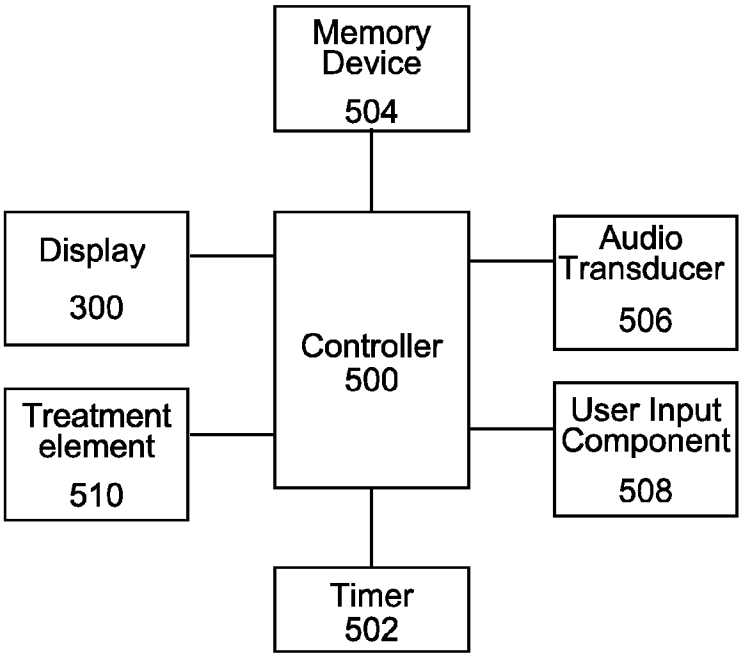
FIG. 3 is a schematic of the user interface, according to an example of the present technology.

FIG. 3 shows a schematic of the components of the user interface of a domestic appliance in accordance with the present technology. The components include a controller 500 for coordinating the operation of the user interface. An audio transducer 506, display 300, and at least one treatment element 510 may be operationally controlled by the controller 500. The controller 500 may be programmed to instruct the audio transducer 506 to emit an audible alert. The controller 500 may also be programmed to instruct the display 300 to emit a visual alert. Additional or alternative alerts that the controller may be able to initiate including sending an email or text message to the user. Also, the controller 500 may be programmed to instruct the treatment element 510 to turn on or off to treat the contents of the appliance. The controller 500 may also program the timer 502 with the treatment time that the user inputs through the user input component 508. The user input component may be any type of component that receives an input from a user. Specifically, it is envisioned that commonly known touchscreen input devices, such as a capacitive touch input element, will comprise the user input component. The user would then manually input the parameters by touching the user interface. A memory device 504 may also be included to store the functional parameters (e.g., treatment time, treatment mode, treatment temperature, etc.) input to the controller 500 through the user input component 508.

The treatment element(s) 510 may be included to facilitate the treatment of contents by the domestic appliance 100. For example, the domestic appliance 100 may also include a chamber that holds the contents and a door to enclose the contents in the domestic appliance 100 and such domestic appliance may be an oven, a dishwasher, a washing machine, a drier, a microwave oven, a coffee maker, a refrigerator, and/or a freezer, etc. Thus, the contents may be food, consumable liquids, crockery, dishes, stoneware, flatware, bakeware, and/or clothing, etc. It is also contemplated that the domestic appliance may not necessarily include a chamber and door for enclosing the contents or items and in such a case the domestic appliance may be a vacuum cleaner, a blender, and an iron, etc. Treatment by the domestic appliance is contemplated to comprise cooking, baking, heating, steaming, sanitizing, disinfecting, cooling, freezing, cleaning, washing, vacuuming, and/or blending, etc. The treatment element 510, in the example where the appliance 100 is an oven and the contents are food, is at least one heating element that may include an electric resistance heating element or a gas burner. A fan may also comprise the treatment element 510 in the case of a convection oven that performs convection heating of the food. Other treatment elements, as commonly known in the art, may also comprise the treatment element.

Figure 4:
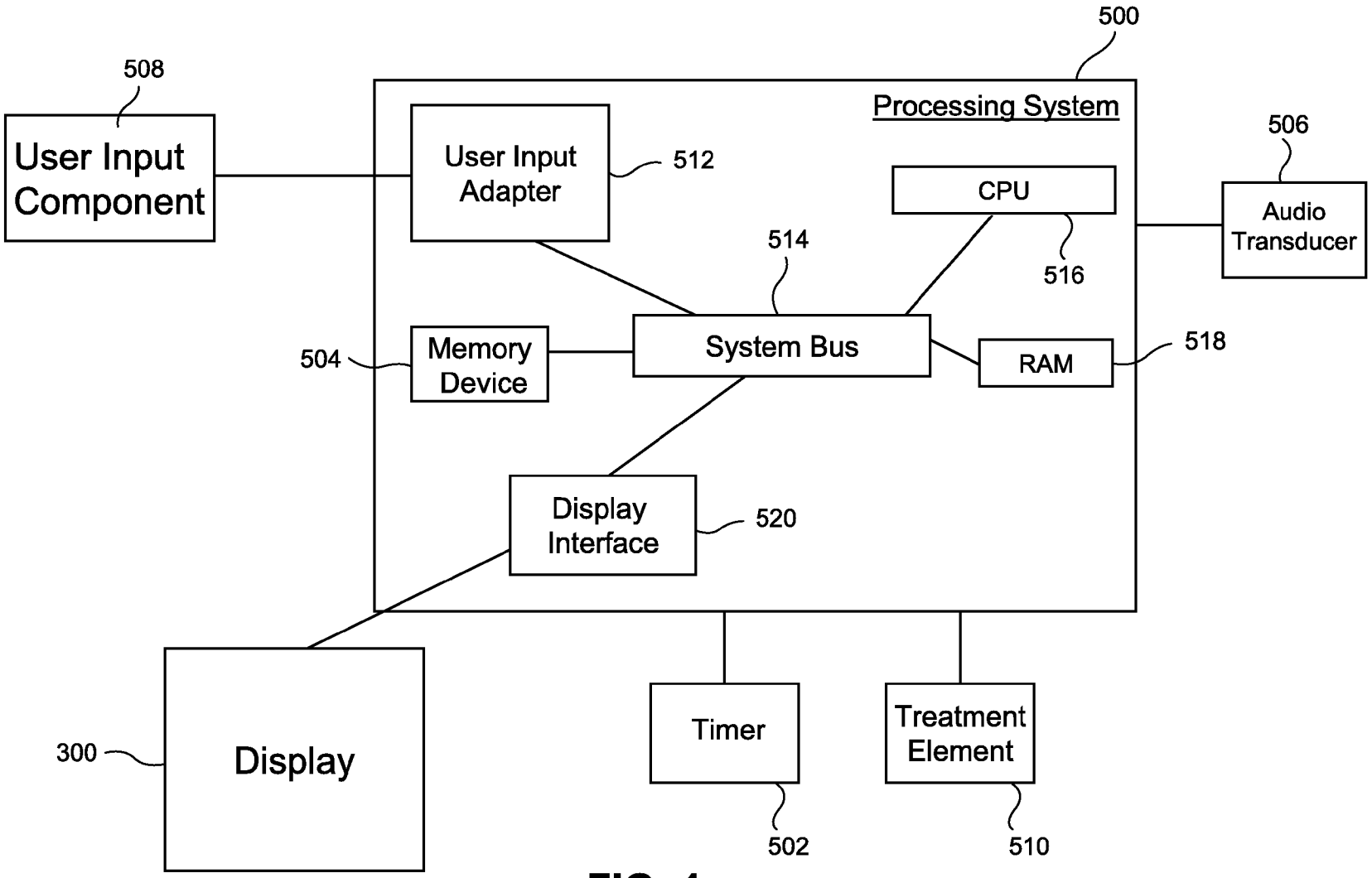
FIG. 4 is a block diagram of a processing system, according to an example of the present technology.

FIG. 4 is a block diagram of an exemplary computing system according to certain examples. A processing system or controller 500 may include a central processing unit or CPU 516, a system bus 514 that communicates with RAM 518 and storage or a memory device 504. The storage 504 can be magnetic, flash based, solid state, or other storage technology. The system bus 514 may also communicate with a user input adapter 512 that allows users input commands to the processing system via a user input component 508 (e.g., a touch input element or the like). The results of the processing may be displayed to a user on a display 300 via a display interface 520 (e.g., a video card or the like).

The processing system 500 may also communicate with the additional components of the domestic appliance, e.g., audio transducer 506, timer 502, and treatment element 510. It should also be noted that the timer 502 may be comprised within the processing system 500, rather than as a separate component.

Certain examples herein are described in terms of sequences of actions that can be performed by, for example, elements of a programmable computer system. It will be recognized that various actions could be performed by specialized circuits (e.g., discrete logic gates interconnected to perform a specialized function or application-specific integrated circuits), by program instructions executed by one or more processors, or by a combination of both.

Figure 5:
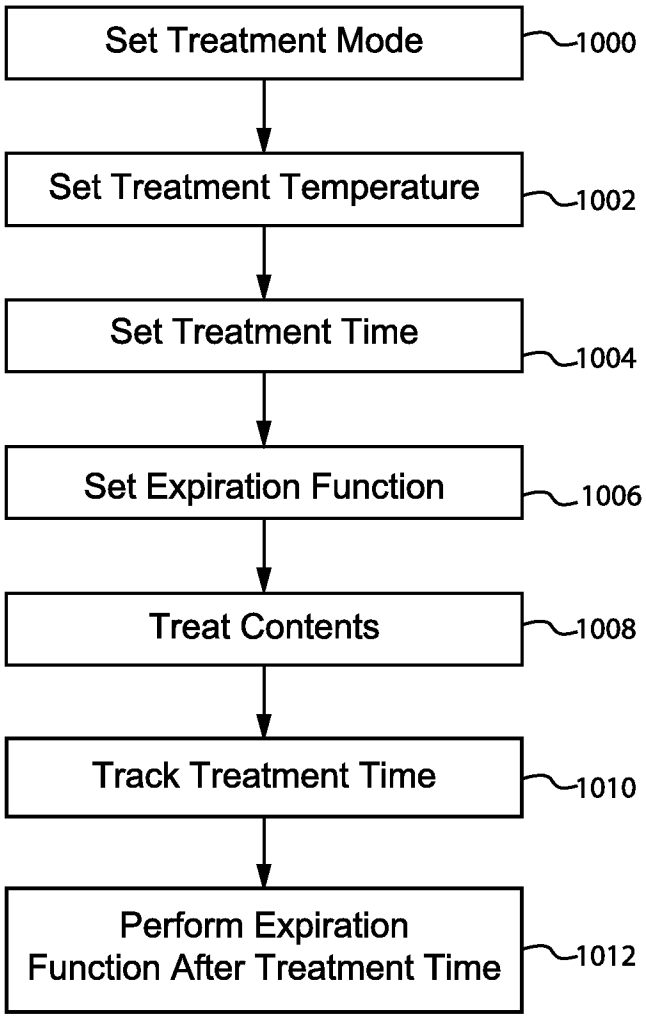
FIG. 5 is a flowchart of a method of controlling an appliance, according to an example of the present technology.
Figure 6:
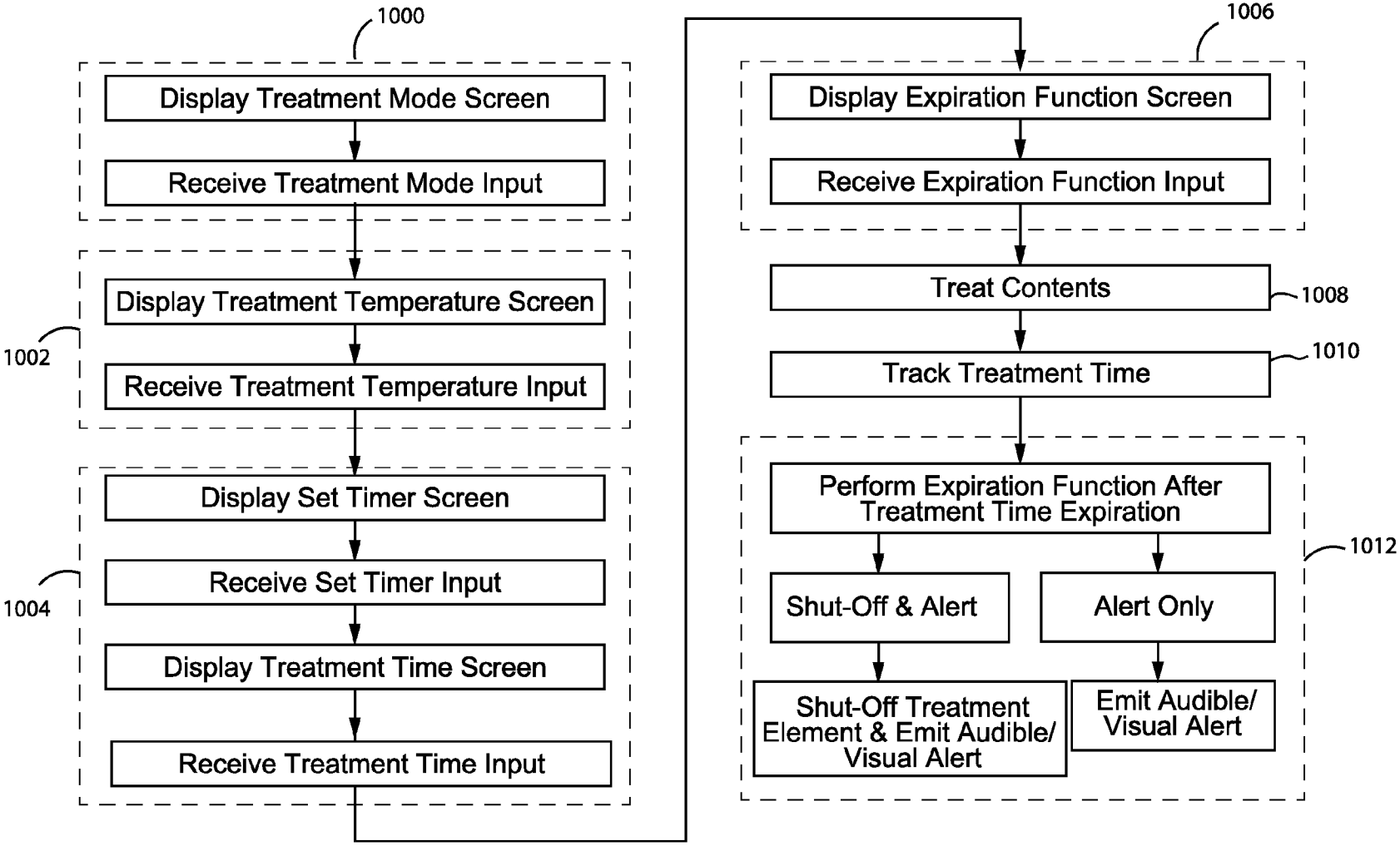
FIG. 6 is another flowchart of a method of controlling an appliance, according to an example of the present technology.
Figure 7:
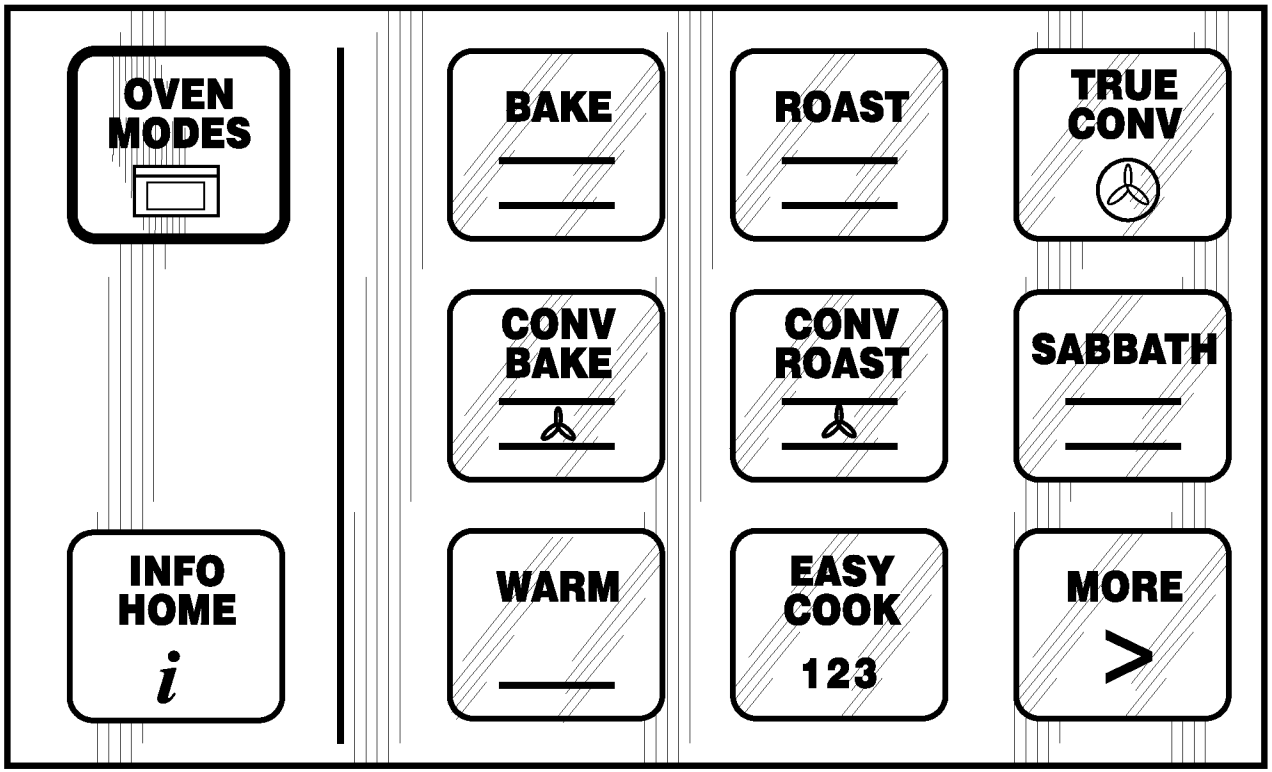
FIG. 7 is a treatment mode screen, according to an example of the present technology.

FIGS. 5 and 6 show corresponding flowcharts detailing an example of the operation of a user interface 200 for a domestic appliance 100, according to an example of the present technology. The user begins the process of operating the domestic appliance 100 to treat contents therein with setting the treatment mode, as exemplified by step 1000. This step 1000 includes the controller 500 directing the display 300 to display a treatment mode screen, wherein the user can select from a variety of treatment modes. An exemplary treatment mode screen is shown in FIG. 7. The user then selects the desired treatment input mode by inputting that mode to the user input component 508.

Figure 8:
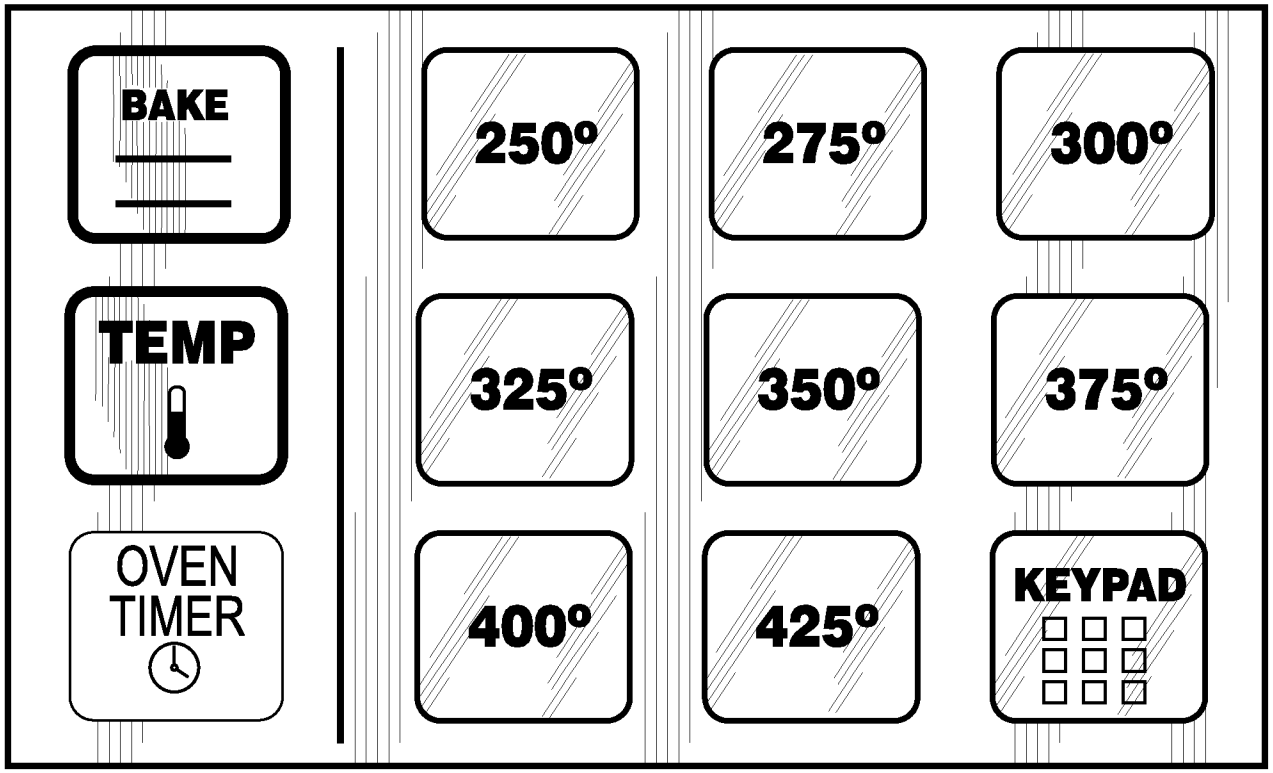
FIG. 8 is a treatment temperature screen, according to an example of the present technology.

The next step is for the user to set the treatment temperature, which is a prescribed temperature according to a recipe, in the example of the oven that cooks food. Once the treatment mode has been selected, according to the previous step discussed above, the controller 500 will then direct the display 300 to display a treatment temperature screen. This function is exemplified by step 1002. An example of a treatment temperature screen is shown in FIG. 8. The desired treatment temperature is then chosen by the user by inputting this parameter through the user input component 508.

Figure 9:
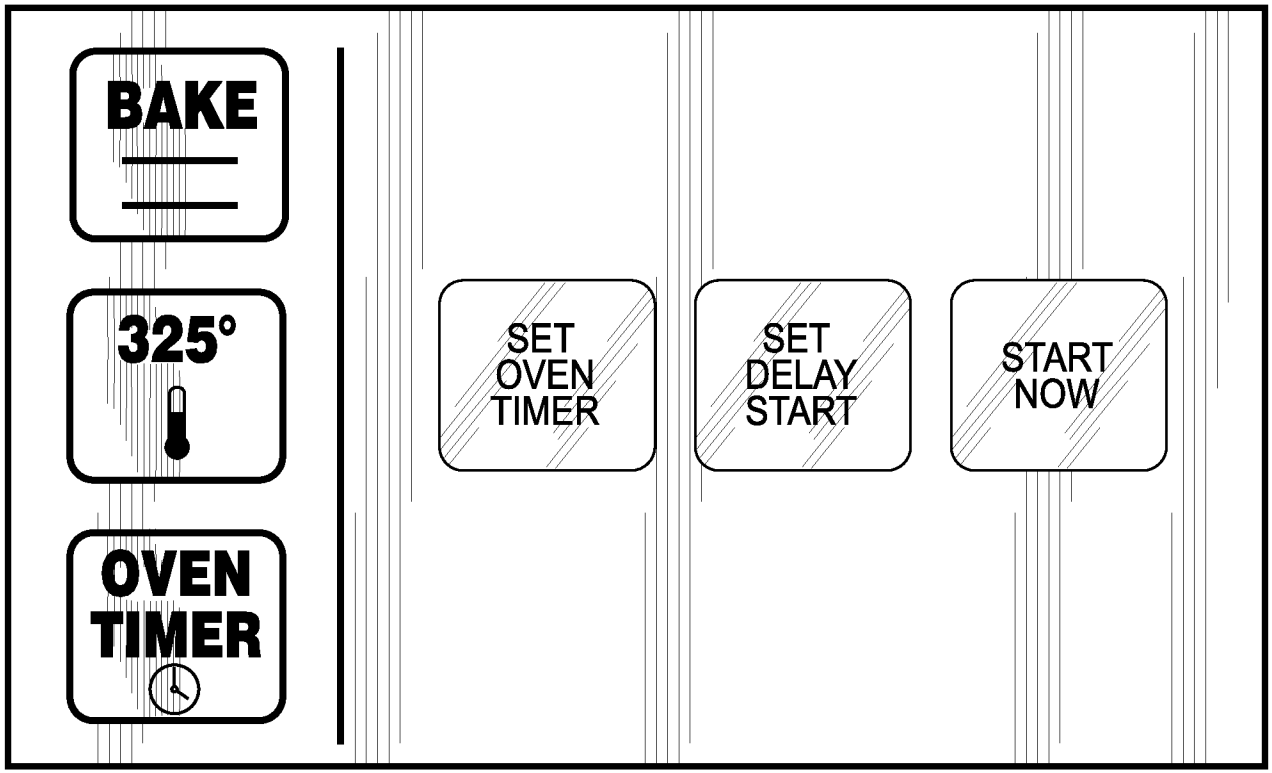
FIG. 9 is a set timer screen, according to an example of the present technology.

The next step is for the user to input whether the treatment of the contents is to be timed by a timer, as exemplified by step 1004. In this step the controller 500 directs the display 300 to show the user a set timer screen, an example of which is shown in FIG. 9. The user may choose to begin treatment right away and not time the treatment by choosing the "START NOW" option or the user may choose to delay the treatment by selecting the "SET DELAY START" option. The user may also choose to set a timer 502 for the treatment and any of these options may be inputted through the user input component 508.

Figure 10:
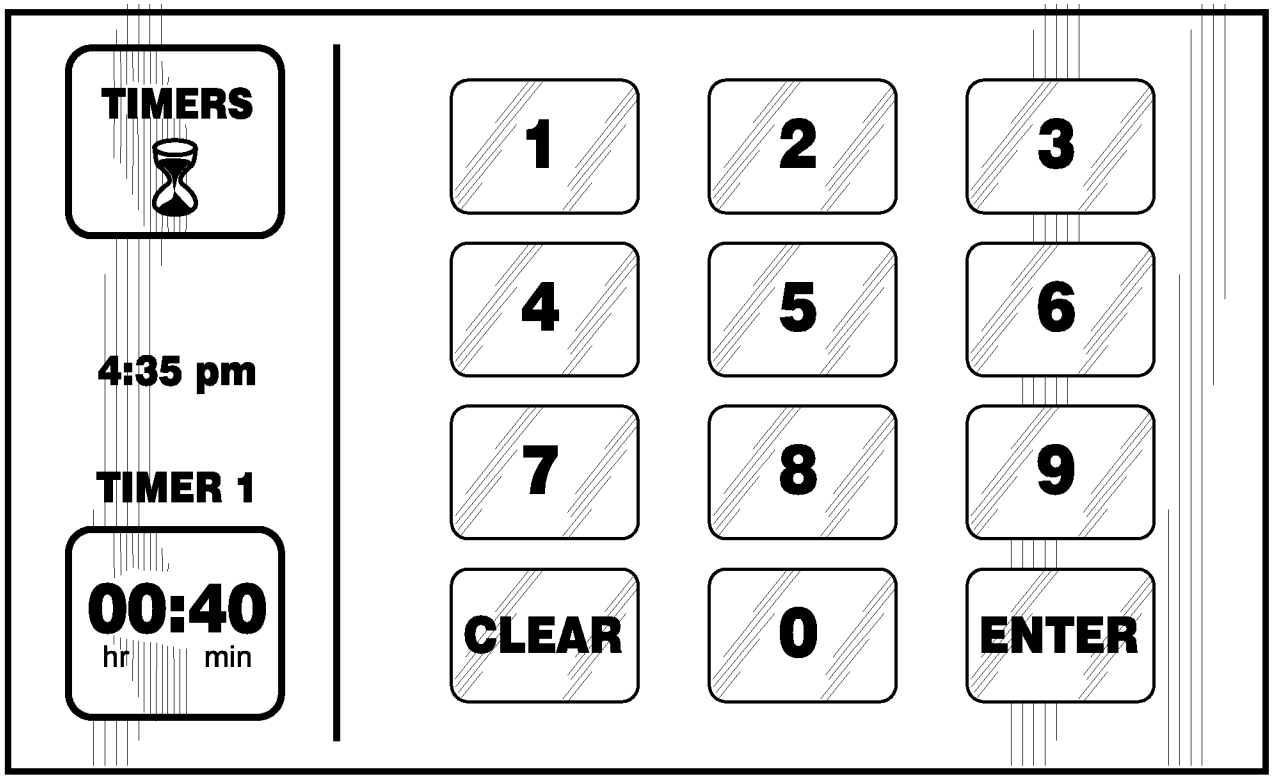
FIG. 10 is a treatment time screen, according to an example of the present technology.

If the user has chosen to have the treatment of the contents timed by a timer 502, the next step will be to set the time for treatment, also exemplified by step 1004. Upon inputting to the controller 500 through the user input component 508 the set timer input, the user will subsequently be displayed a treatment time screen. FIG. 10 shows an exemplary treatment time screen wherein the user inputs, through the user input component 508 to the controller 500, the desired treatment time.

Figure 11:
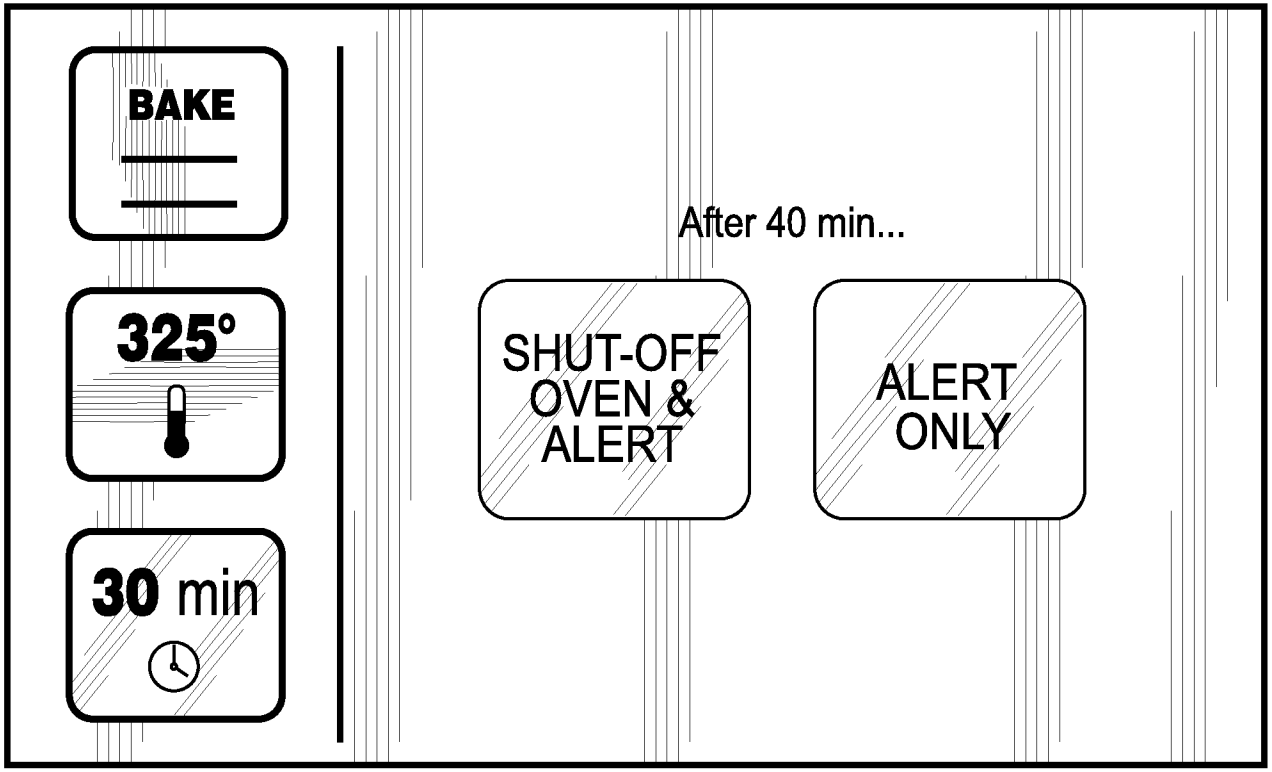
FIG. 11 is an expiration function screen, according to an example of the present technology.

The last step of programming the operational parameters follows the inputting of the desired treatment time. In this step, exemplified by step 1006, the controller 500 instructs the display 300 to display an expiration function screen where the user can select what function is performed upon expiration of the treatment time. An example of the expiration function screen is shown in FIG. 11. The user, when displayed this screen by the display 300, may choose between an alert function and a shut-off function. If the alert function is chosen, the controller 500 may initiate an alert function, e.g., instructing the display 300 to emit a visual alert and/or instructing the audio transducer 506 to emit an audible alert, upon expiration of the treatment time. Alternative or additional alerts may also be emitted such as an email message or text message. If the shut-off function is chosen, the controller 500 will instruct the treatment element 510 to shut off upon expiration of the treatment time, along with instructing the display 300 to emit a visual alert and/or instructing the audio transducer 506 to emit an audible alert.

Once each operational parameter is inputted to the controller 500 through the user input component 508, each parameter may be stored in a memory device 504 of the user interface 200.

Also, once each operational parameter is inputted by the user, the domestic appliance 100 is ready to initiate treatment of its contents. At this point the treatment element 510 may be turned on by the controller 500 to begin treatment at the instruction of the user with user input, as exemplified by step 1008.

Once treatment has begun the timer 502 of the user interface 200 tracks the treatment time. This function is exemplified by step 1010. Upon expiration of the treatment time, the timer 502 communicates to the controller 500 that the treatment time has expired. The controller 500 then initiates the expiration function as inputted by the user, which is exemplified by step 1012. If the user has selected the alert function, the audio transducer 506 will be instructed to sound an audible alert and/or the display 300 will be instructed to show a visual alert, both of which are intended to inform the user that the treatment time has expired and the contents have been treated for the desired period of time. If the user has selected the shut-off function, either or both of the alerts will be emitted at the instruction of the controller 500 and the controller will also shut off the treatment element 510. In this case, the user, if present, will be alerted that the treatment time has expired so that the user can remove the contents and halt their treatment, but if the user is not present the treatment element 510 will also be turned off to cease their treatment beyond the prescribed period of time.

While the present technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the technology.

What is claimed is:

1. A domestic appliance with timer control to treat contents, the domestic appliance comprising:

a timer programmed to track a treatment time period;

a display configured to display a plurality of screens;

at least one user input component programmed to:

receive a treatment time input corresponding to a treatment time; and receive an expiration function input corresponding to an expiration function subsequent to receiving the treatment time input;

a treatment element;

an expiration element; and a controller programmed to:

set the timer with the treatment time in accordance with the received treatment time input;

set the expiration function;

control the treatment element to perform a treatment of the contents for the duration of the treatment time; and at the expiration of the treatment time, control the treatment element to end the treatment of the contents and control the expiration element of the domestic appliance to perform the expiration function.

2. The domestic appliance of claim 1, wherein the expiration function comprises:

an alert function comprising an audible alert and/or a visual alert; or a shut-off function comprising shutting off the treatment element and at least one of the audible alert and the visual alert.

3. The domestic appliance of claim 2, further comprising:
an audio transducer configured to emit the audible alert
wherein the display is configured to display the visual alert, and
the controller is configured to:
direct the audio transducer to emit the audible alert;
direct the display to emit the visual alert; and/or
control the treatment element.

4. The domestic appliance of claim 3, wherein the controller is programmed to shut off the treatment element in accordance with the shut-off function.

5. The domestic appliance of claim 4, wherein the timer is programmed to indicate to the controller that the treatment time has expired.

6. The domestic appliance of claim 5, wherein the controller is programmed to initiate the expiration function after the treatment time has expired.

7. The domestic appliance of claim 1, further comprising:
a treatment chamber for heating the contents, the heating of the contents being the treatment; and
a door to enclose the contents in the treatment chamber.

8. The domestic appliance of claim 1, wherein the display comprises a thin film transistor display.

9. The domestic appliance of claim 1, wherein the at least one user input component comprises a capacitive touch input element.

10. The domestic appliance of claim 1, further comprising;
a memory device to store the treatment time input and the expiration function input.

11. The domestic appliance of claim 1, wherein the plurality of screens comprises a treatment mode screen, a treatment temperature screen, a set timer screen, a treatment time screen, and an expiration function screen.

12. The domestic appliance of claim 1, wherein the controller is programmed to direct which of the plurality of screens is displayed by the display.

13. A method for controlling a domestic appliance to treat contents, the domestic appliance having a display, at least one user input component, a treatment element, an expiration element, and a controller, the method comprising:
displaying a treatment time screen;
receiving a treatment time input corresponding to a treatment time from the at least one user input component;
subsequent to receiving the treatment time input:
displaying an expiration function screen; and
receiving an expiration function input corresponding to an expiration function from the at least one user input component;
controlling the treatment element with the controller to perform a treatment of the contents for the duration of the treatment time; and
at the expiration of the treatment time, controlling the treatment element with the controller to end the treatment of the contents and controlling the expiration element of the domestic appliance with the controller to perform the expiration function.

14. The method of claim 13, wherein the domestic appliance further comprises a timer, and
wherein the method further comprises programming the timer to track the treatment time.

15. The method of claim 14, further comprising:
tracking the treatment time with the timer.

16. The method of claim 13, wherein the expiration function comprises an alert function to alert a user or a shut-off function to cease treatment of the contents and alert the user.

17. The method of claim 16, wherein the domestic appliance further comprises an audio transducer, and
wherein the method further comprises:
performing, according to the expiration function input, the alert function by emitting an audible alert with the audio transducer and/or emitting a visual alert with the display, or
performing the shut-off function by shutting off the treatment element and at least one of emitting an audible alert with the audio transducer and emitting a visual alert with the display.

18. The method of claim 13, further comprising;
displaying a treatment mode screen;
receiving a treatment mode input corresponding to a treatment mode from the at least one user input component;
displaying a treatment temperature screen;
receiving a treatment temperature input corresponding to a treatment temperature from the at least one user input component;
displaying a set timer screen; and
receiving a set timer input from the at least one user input component.

19. The method of claim 18, wherein the domestic appliance further comprises a memory device, and
wherein the method further comprises storing the treatment mode input, the treatment temperature input, the set timer input, the treatment time input, and the expiration function input on the memory device.

* * * * *